US006701886B2

(12) United States Patent
Walter et al.

(10) Patent No.: US 6,701,886 B2
(45) Date of Patent: Mar. 9, 2004

(54) COMBUSTION CONTROL METHOD AND DEVICE FOR AN INTERNAL-COMBUSTION ENGINE

(75) Inventors: Bruno Walter, Nanterre (FR); Bertand Gatellier, Bougival (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 10/200,505

(22) Filed: Jul. 23, 2002

(65) Prior Publication Data

US 2004/0016415 A1 Jan. 29, 2004

(51) Int. Cl.[7] ..... F02B 3/00
(52) U.S. Cl. ..... 123/294; 123/568.11
(58) Field of Search ..... 123/294, 568.11, 123/568.15, 299

(56) References Cited

U.S. PATENT DOCUMENTS 4,002,151 A * 1/1977 Toyoda et al. ..... 123/3

FOREIGN PATENT DOCUMENTS

| | | |
|---|---|---|
| DE | 19519663 | 5/1996 |
| DE | 19810935 | 9/1999 |
| GB | 2277776 | 11/1994 |
| WO | 0061927 | 10/2000 |

* cited by examiner

*Primary Examiner*—Bibhu Mohanty
(74) *Attorney, Agent, or Firm*—Antonelli, Terry, Stout & Kraus, LLP

(57) ABSTRACT

The present invention relates to a method of controlling the combustion by autoignition of a homogeneous fuel mixture for an internal-combustion engine comprising a combustion chamber in which a stage of slow oxidation of said mixture occurs prior to the combustion of this mixture. A determined amount of fuel is fed into the combustion chamber during the slow oxidation of the mixture so as to lengthen this oxidation stage.

13 Claims, 1 Drawing Sheet

COMBUSTION CONTROL METHOD AND DEVICE FOR AN INTERNAL-COMBUSTION ENGINE

FIELD OF THE INVENTION

The present invention relates to a combustion control method and device for an internal-combustion engine.

More particularly, it relates to the combustion of a homogeneous mixture of fuel with the intake air or with a mixture of air and recirculated exhaust gas (EGR).

BACKGROUND OF THE INVENTION

Reduction of the emissions generated by internal-combustion engines, combined with a reduction of the consumption, is of constant concern to internal-combustion engine developers.

In new engine generations, for low and medium loads, the combustion of the fuel mixture, conventionally ignited either by compression or by a plug, is to be replaced by an ignition by compression of a homogeneous charge type combustion.

This is notably known for Diesel engines as <<(Homogeneous Charge Compression Ignition>> (HCCI) and, for gasoline engines, for a combustion mode called <<Controlled Auto Ignition>> (CAI).

This combustion is obtained when the homogeneous mixture of fuel, air and possibly recirculated exhaust gas has reached a certain temperature threshold which favours its autoignition combustion.

Generally, this type of combustion is characterised by a stage of slow oxidation of the fuel mixture prior to the combustion of this mixture.

This type of combustion allows to reduce considerably the nitrogen oxides (NOx) and particles emissions discharged by the engine.

However, this combustion involves a certain number of drawbacks which are by no means insignificant.

In fact, it is necessary to obtain a good combustion timing, i.e. to determine the exact moment when the fuel mixture ignites, so that this combustion occurs notably when the position of the piston has reached its appropriate position at the time when the fuel mixture has all the physico-chemical characteristics required for autoignition.

Many means exist to this end, such as feeding steam into or using recirculated exhaust gas in the combustion chamber.

The most commonly used means to obtain the required timing consists in feeding into or in keeping in the combustion chamber exhaust gas from the engine, referred to as recirculated exhaust gas, with a high proportion so as to time the combustion at the desired time.

This recirculated exhaust gas allows the combustion to be <<calmed down>> as it reduces the oxygen content ($O_2$) of the fuel mixture.

However, these high proportions of recirculated exhaust gas lead to high fuel/air ratios that are close to stoichiometric conditions, which reduces all the more the operating range of the engine. In fact, beyond a fuel/air ratio above 0.96, the fuel mixture no longer contains enough oxygen to burn properly.

Furthermore, because of these high fuel/air ratios, emissions such as carbon oxide (CO), unburnt hydrocarbons (HC) and fumes are of high amplitude.

The present invention aims to overcome the aforementioned drawbacks by providing a combustion control method allowing to obtain the desired combustion timing.

SUMMARY OF TIE INVENTION

To this end, a method of controlling the combustion by autoignition of a homogeneous fuel mixture for an internal-combustion engine comprising a combustion chamber in which a stage of slow oxidation of said mixture occurs prior to the combustion of this mixture is characterised in that a determined amount of fuel is fed into the combustion chamber during the slow oxidation of the fuel mixture so as to lengthen this oxidation stage.

Advantageously, the determined amount of fuel can be introduced in at least one fuel injection.

Preferably, an amount of fuel less than or equal to 10 $mm^3$ can be introduced.

This amount of fuel can range between 1 and 8 $mm^3$.

Preferably, a fuel mixture consisting of fuel, air and recirculated exhaust gas can be prepared in the combustion chamber.

A fuel mixture can be prepared with a maximum exhaust gas recirculation ratio of the order of 0.7.

The fuel introduced can be of gasoline or Diesel type.

The invention also relates to a device for controlling the combustion by autoignition of a homogeneous fuel mixture for an internal-combustion engine comprising a combustion chamber in which a stage of slow oxidation of said mixture occurs prior to the combustion of the fuel mixture, characterised in that it comprises means for controlling the injection of a determined amount of fuel during the stage of slow oxidation of this mixture.

The control means can be the engine computer which controls the fuel injectors.

BRIEF DESCRIPTION OF THE DRAWING

Other features and advantages of the invention will be clear from reading the description hereafter, with reference to the accompanying sole FIGURE showing the pressure and energy release curves in the combustion chamber as a function of the crankshaft angle.

DETAILED DESCRIPTION

Figure 1:
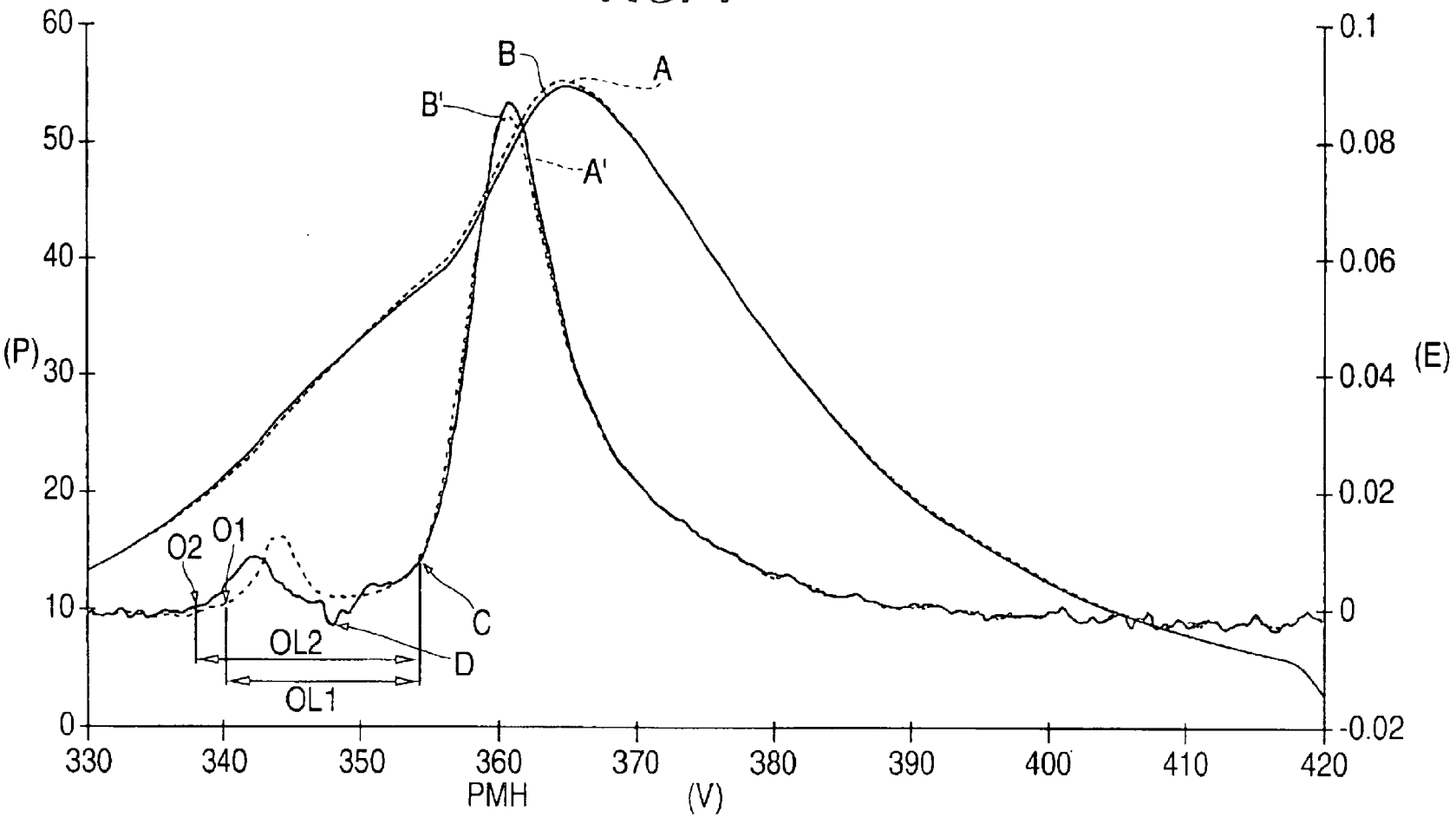

In this figure, curves A and B show the evolution of pressure P (in bars) in a combustion chamber of a Diesel type internal-combustion engine as a function of crankshaft angle V (in degrees), and curves A' and B' show the evolution of the release of energy E inside this chamber as a function of the crankshaft angle, without and with the method according to the invention respectively.

The combustion chamber is generally delimited by the upper face of a piston, the wall of a cylinder in which this piston slides with a reciprocating linear motion, and the inner face of a cylinder head closing the cylinder.

For simplification reasons, the crankshaft angle is mentioned in the description, but it is clear that this angle corresponds to a precise position of the piston which moves in the cylinder under the effect of a connecting rod-crank system controlled by the crankshaft.

As can be seen in the sole figure, curve A (in dotted line) shows the evolution of the pressure prevailing in the combustion chamber with a fuel mixture having a fuel/air ratio of the order of 0.96 and comprising Diesel fuel, air and a proportion of recirculated exhaust gas corresponding to about 70% of the total mixture.

At about 260° crankshaft angle, the fuel is fed into the combustion chamber by means of a first injection, then, at about 320° crankshaft angle, by means of a second injection so as to obtain, at about 360°, which corresponds to the compression top dead center (PMH), quasi-homogeneous mixing of the fuel, the air and the recirculated exhaust gas. In a parallel step, the pressure in the combustion chamber increases substantially linearly and reaches a maximum value in the neighbourhood of the top dead center. From this position, the pressure decreases and reaches substantially the atmospheric pressure at about 420° crankshaft angle.

Simultaneously, with reference to curve A' (in dotted line), the energy release in this combustion chamber will be substantially zero at the end of the second injection (at about 320° crankshaft angle) up to about 340° crankshaft angle. Then, from this point, the homogeneous fuel mixture, under the effect of the compression notably, undergoes a slow oxidation stage which starts at point O1 and lasts for a certain time (shown by OL1 in the FIGURE) while preceding the combustion start of this fuel mixture (shown by arrow C in the FIGURE). This combustion leads to a high energy release up to about 360° crankshaft angle (PMH), then the energy stored in the combustion chamber decreases until it reaches a quasi-zero value at about 400° crankshaft angle.

It is clear that, if it is desired to lag the time C when the combustion of the fuel mixture starts in order to improve the engine efficiency, the most commonly used solution consists in increasing the proportion of recirculated exhaust gas present in the combustion chamber and, therefore, the emissions such as carbon oxides will rapidly increase.

In order to obtain the desired timing while reducing emissions, the applicant proposes feeding into the combustion chamber, during the stage of slow oxidation of the fuel mixture and at a determined time of this stage, a determined amount of fuel.

This fuel will be supplied either by means of a single injection or by means of a multitude of injections.

This late fuel supply thus allows to absorb part of the energy released in the combustion chamber by the fuel mixture in the slow oxidation stage, this absorbed energy being used for the vaporization of the late injected fuel.

This absorbed energy is then restored as the slow oxidation of the fuel mixture progresses while lengthening this slow oxidation stage until the characteristics (temperature notably) required for the combustion of the fuel mixture to start are reached.

The combustion start of the fuel mixture is thus delayed through lengthening of the slow oxidation stage.

By way of example, the applicant has carried out tests with a known fuel mixture combustion method (curves A and A' in dotted line) and with the method according to the invention (curves B and B' in full line in the figure).

As already mentioned, the fuel mixture of curves A and A' contains about 70% recirculated exhaust gas and the fuel/air ratio is of the order of 0.96. After combustion of this mixture, the carbon oxides (CO) emissions were of the order of 40 g/kWh.

During these tests, the proportion of recirculated exhaust gas in the fuel mixture has been significantly decreased (proportion of the order of 60%), which has entailed the advantage of considerably decreasing the fuel/air ratio of this mixture (of the order of 0.91), and the results obtained by means of the applicant's method are shown by curves B and B'.

Normally, as a result of the decrease in the proportion of recirculated gas and therefore of the presence of a larger amount of oxygen, the stage of slow oxidation of the fuel mixture starts earlier (at about 335° crankshaft angle), and the combustion generally starts after an angular displacement of the crankshaft of about 15°, so that the combustion starts in the chamber at about 350°. During the combustion process, the maximum energy release peak is obtained when the piston has not reached its top dead center position yet, which leads to an engine disturbance, notably as regards the engine efficiency.

According to the method used by the applicant and with reference to curve B', the slow oxidation of the fuel mixture also starts early (point O2) at about 335° crankshaft angle but, by feeding a determined amount of fuel into the combustion chamber, the slow oxidation stage is lengthened (OL2 in the figure) and ends at point C which represents the combustion start of the fuel mixture as in curve A'.

Generally speaking, this amount of late supplied fuel is less than or equal to 50% of the total amount of fuel introduced and it preferably ranges between 10 and 40% of this total amount.

The total amount mentioned above comprises the fuel injection(s) performed prior to the slow oxidation stage in order to obtain the homogeneous fuel mixture and the injection(s) performed during the slow oxidation stage.

More precisely, an amount of fuel less than or equal to 10 $mm^3$, preferably ranging between 1 and 8 $mm^3$, is to be introduced.

By way of example, during tests carried out by the applicant, for a total amount of fuel injected of 8.6 $mm^3$, the amount of fuel introduced (in two injections) during the slow oxidation stage is 3 $mm^3$, i.e. about 37%.

For these tests, the applicant has injected the fuel during the slow oxidation stage at a crankshaft angle corresponding to about −15° in relation to the top dead center.

As can be seen in curve B', the consequence of the amount of fuel injected is to absorb an amount of energy (shown by arrow D in the figure) generated by the slow oxidation of the fuel mixture, then the absorbed energy is restored as this stage progresses until the fuel mixture has obtained all the characteristics required for its combustion to occur at point C.

From this point, the energy release is practically identical to that of the fuel mixture described in connection with curve A'.

Furthermore, as can be seen in the figure and with reference to curve B, the latter follows substantially the evolution of curve A and thus allows to obtain the same pressure characteristics prevailing in the combustion chamber.

The invention thus allows to obtain, with a fuel mixture containing a lower proportion of recirculated exhaust gas and with a lower fuel/air ratio, the same pressure and energy release characteristics with the same crankshaft angles as a mixture with a high proportion of recirculated exhaust gas.

Furthermore, the applicant's method has allowed to significantly decrease the carbon oxide (CO) emissions, with a discharge of the order of 29 g/kWh.

Of course, the present invention can be applied with fuel mixtures containing gasoline or Diesel type fuels.

Thus, for a mixture of gasoline, air and recirculated gas, the autoignition combustion is preceded, as in the examples described above, by a stage of slow oxidation of this mixture.

A determined amount of gasoline can thus be introduced (in one or more injections) to lengthen this slow oxidation stage and to time the combustion start at the desired time.

Preferably, this method applies to low or medium engine loads, and conventional combustion methods will be used for high loads.

The invention described above will be applied for an internal-combustion engine comprising the control means required to contain the late injection parameters (time of the late fuel injection, amount of fuel, number of injections, . . . ) and to control accordingly the associated fuel injectors which this engine is commonly equipped with.

The engine computer provided in most internal-combustion engines will advantageously be used to contain these parameters and to control the fuel injectors accordingly.

What is claimed is:

1. A method of controlling the combustion by autoignition of a homogeneous fuel mixture for an internal-combustion engine comprising a combustion chamber in which a stage of slow oxidation of said mixture occurs prior to the combustion of this mixture, characterised in that a determined amount of fuel is fed into the combustion chamber during slow oxidation of the fuel mixture so as to lengthen the stage of slow oxidation.

2. A method as claimed in claim 1, chacterised in that the determined amount of fuel is introduced in at least one fuel injection.

3. A method as claimed in claim 1, characterised in that an amount of fuel less than or equal to 10 $mm^3$ is introduced.

4. A method as claimed in claim 3, characterised in that an amount of fuel ranging between 1 and 8 $mm^3$ is introduced.

5. A method as claimed in claim 1, characterised in that a fuel mixture comprising fuel, air and recirculated exhaust gas is prepared in the combustion chamber.

6. A method as claimed in claim 5, characterised in that a fuel mixture with a maximum ratio of recirculated exhaust gas of the order of 0.7 is prepared.

7. A method as claimed in claim 1, characterised in that a fuel of gasoline type is introduced.

8. A method as claimed in claim 1, characterised in that a fuel of Diesel type is introduced.

9. A device for controlling the combustion by autoignition of a homogeneous fuel mixture for an internal-combustion engine comprising a combustion chamber in which a stage of slow oxidation of said mixture occurs prior to the combustion of the fuel mixture, characterised in that it comprises means for controlling the injection of a determined amount of fuel during the slow oxidation of this mixture so as to lengthen the stage of slow oxidation.

10. A device as claimed in claim 9, characterised in that the control means are the engine computer controlling the fuel injectors.

11. A method as claimed in claim 1, characterised in that the determined amount of fuel is introduced in a single injection.

12. A method as claimed in claim 1, characterised in that the determined amount of fuel is introduced in multiple injections.

13. A method as claimed in claim 5, characterised in that a fuel mixture with a maximum ratio of recirculated exhaust gas of the order of 0.6 is prepared.

* * * * *